United States Patent [19]

Murata et al.

[11] Patent Number: 4,573,422

[45] Date of Patent: Mar. 4, 1986

[54] SHIP WITHOUT TRANSVERSE REINFORCING MEMBERS BETWEEN THE INNER AND OUTER HULL PLATING

[75] Inventors: Seiichiro Murata; Masaru Tateishi, both of Sakai; Kohji Hayakawa, Nishinomiya; Takeshi Sakamoto, Suita; Shin Takeuchi; Kohsuke Mukasa, both of Arao, all of Japan

[73] Assignee: Hitachi Zosen Corporation, Osaka, Japan

[21] Appl. No.: 628,467

[22] Filed: Jul. 6, 1984

[30] Foreign Application Priority Data

Jul. 11, 1983 [JP] Japan ..... 58-107853[U]

[51] Int. Cl.[4] ..... B63B 3/62

[52] U.S. Cl. ..... 114/65 R; 114/74 R

[58] Field of Search ..... 114/65 R, 65 A, 72, 114/73, 74 R, 74 A

[56] References Cited

U.S. PATENT DOCUMENTS

| | | | |
|---|---|---|---|
| 2,364,522 | 12/1944 | Ganteaume | 114/65 A |
| 3,255,724 | 6/1966 | Campbell et al. | 114/73 |
| 3,498,249 | 3/1970 | Jones | 114/65 A |

*Primary Examiner*—Sherman D. Basinger

*Attorney, Agent, or Firm*—Barnes, Kisselle, Raisch, Choate, Whittemore & Hulbert

[57] ABSTRACT

A transverseless ship has at least its side portions and bottom portion comprised of a double hull construction which comprises an inner hull plating and an outer hull plating connected together only by transverse bulkheads and a plurality of longitudinal connecting member fixed to the bulkheads. The bottom portion of the ship has a space defined by at least two optionally selected connecting longitudinal members and divided by two horizontal partitions into two upper chambers and a lower chamber. The upper chambers are adapted to pass different fluids therethrough, and the lower chamber is provided with docking brackets each conforming to the sectional shape thereof. With this structure, external forces acting on the ship are delivered from the connecting longitudinal members to the transverse bulkheads to prevent the inner and outer platings from buckling. The absence of reinforcing transverse members intersecting the connecting longitudinal members assures automatic welding operation with greatly improved efficiency. Since the space within the double hull is utilized to provide fluid channels, there is no need to provide additional fluid transport piping. The docking bracket provided under the fluid channel prevents the bottom portion from deforming when the ship is supported on blocks within a dock.

4 Claims, 3 Drawing Figures

SHIP WITHOUT TRANSVERSE REINFORCING MEMBERS BETWEEN THE INNER AND OUTER HULL PLATING

The present invention relates to a transverseless ship, and more particularly to a structure for tankers and like cargo ships. By "transverseless" is meant a structure without reinforcing transverse members.

BACKGROUND AND SUMMARY OF THE INVENTION

With a navigating tanker, various forces act on the hull. For example, the hull itself is subjected to a longitudinal bending moment and torsional forces, the outer bottom plating and the outer side plating to the pressure of water, and the inner bottom plating and side wall of the hold (oil tank) to the load of oil cargo under gravity. To withstand these forces, the hull includes a large number of structural members such as longitudinal members (side longitudinal members, bottom longitudinal members, central girder, etc.) extending longitudinally of the ship and reinforcing transverse members (side reinforcing transverse members, bottom reinforcing transverse members, etc.) provided transversely of the ship. In the case of such a structure, however, longitudinal members and reinforcing transverse members are provided in an intersecting arrangement, so that difficulties are encountered in building the hull by automatic work procedures (e.g. automatic welding). To assure automatic work procedures, therefore, we have conceived of a double shell structure which comprises longitudinal members only and includes no reinforcing transverse members. Nevertheless, use of the double shell structure for the hull involves various problems. For example, when the double shell structure is used only for the bottom of a ship of conventional construction, an external force acting on the outer side plating is transmitted to the bottom portion through reinforcing transverse members provided inside the outer side plating, but the inner and outer bottom platings will buckle because the bottom portion has no reinforcing transverse members. Conversely if the double shell structure is used for the side portion only, an external force acting on the bottom and delivered to the side portion through bottom reinforcing transverse members will buckle the inner and outer side platings because the side portion has no vertical reinforcing transverse members.

An object of the present invention is to provide a transverseless ship which has a double shell structure comprising an inner hull plating and an outer hull plating connected thereto by longitudinal members only and which is nevertheless free of the problem of buckling of the inner and outer platings, the double shell structure having an interior space which is advantageously used owing to the absence of reinforcing transverse members.

To fulfill the above object, the present invention provides a transverseless ship comprising at least opposite side portions and a bottom portion each having a double shell structure, the double shell structure comprising an inner hull plating and an outer hull plating connected together only by a plurality of connecting longitudinal members fixed to transverse bulkheads spaced apart longitudinally of the ship except by the transverse bulkheads, the bottom portion having a space defined by at least two optionally selected connecting longitudinal members and divided by a partition into upper chamber means and a lower chamber, the upper chamber means being adapted to pass a fluid therethrough, the lower chamber being provided with docking brackets conforming to the sectional shape thereof.

With the structure described, an external force acting on the hull can be transmitted through the connecting longitudinal members to the transverse bulkheads having sufficient strength to thereby prevent the inner and outer platings from buckling. Since at least one of the spaces defined by the connecting longitudinal members is utilized as a fluid channel, there is no need to provide additional fluid transport piping. The docking brackets provided under the fluid channel prevents the bottom portion from deforming when the ship is supported on blocks within a dock.

Further because the double shell structure has an inner hull plating and an outer hull plating which are connected together substantially by connecting longitudinal members only, the transverseless ship has the following advantages.

(1) Absence of reinforcing transverse members decreases the number of components, while absence of intersections between the connecting longitudinal members with reinforcing transverse members makes it possible to build the hull by automatic work procedures (e.g. automatic welding) with a greatly improved efficiency, further facilitating perfect inspection of the space defined by the inner and outer hull platings.

(2) Because the connecting longitudinal members have no intersections with reinforcing transverse members, cracking is avoidable that would otherwise result from stress concentration at such intersections.

(3) Spaces defined by the inner and outer hull platings and divided by the connecting longitudinal members only can be utilized as ballast tanks. Moreover, the ballast tank, which is not divided by reinforcing transverse members longitudinally of the ship drains completely with ease.

(4) Even if a flammable liquid or gas should ingress into a space between the inner and outer hull platings owing to damage to the inner plating, the liquid or gas can be easily drawn off from the space to eliminate an explosion hazard since there is no transverse dividing the space longitudinally of the ship.

(5) Absence of reinforcing transverse members facilitates stress analysis for the hull and assures a rational arrangement of components for a weight reduction.

(6) The double shell structure prevents outflow of cargo oil in the event of a collision with other ship or stranding.

(7) Since the hold has no inside projections such as stiffeners, the inside wall of the hold can be coated, washed or stripped efficiently and properly and is smaller in the surface area to be coated.

Various features and advantages of the present invention will become apparent from the following description of embodiments with reference to the accompanying drawings.

DETAILED DESCRIPTION

Figure 1:
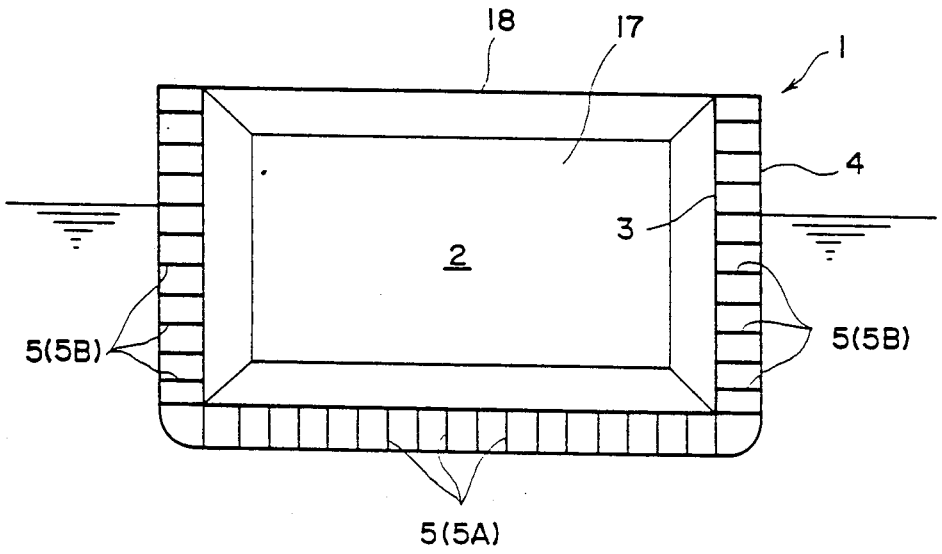
FIG. 1 is a diagram in transverse section schematically showing the overall construction of a transverseless ship according to an embodiment of the invention.

With reference to FIG. 1, indicated at 1 is a transverseless ship such as a tanker. The tanker 1 has opposite side portions and a bottom portion defining holds 2 and each having a double shell structure which comprises an inner hull plating 3 and an outer hull plating. The inner hull plating 3 and the outer hull plating 4 are connected together substantially only by connecting longitudinal members 5 extending longitudinally of the ship.

Figure 2:
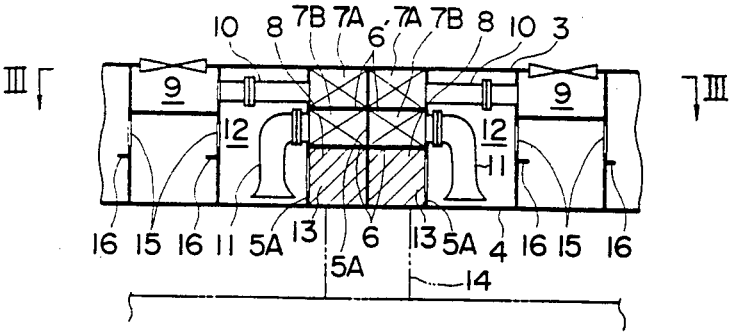
FIG. 2 is a fragmentary diagram in transverse section showing the ship.
Figure 3:
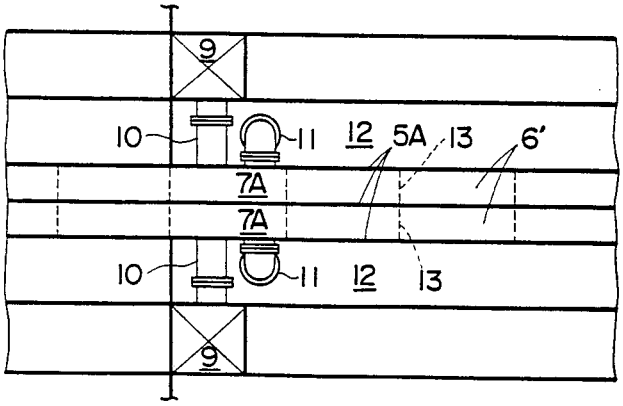
FIG. 3 is a diagram in section taken along the line III—III in FIG. 2.

FIG. 2 and FIG. 3 show two spaces defined by three adjacent connecting longitudinal members 5A in the center of the bottom portion of the ship. Each of the spaces is divided by a first partition 6 and a second partition 6' into a first upper chamber 7A, a second upper chamber 7B and a lower chamber 8. Different fluids are passed through the first and second upper chambers 7A, 7B. For example, when the ship is a tanker, the first upper chamber 7A is used for transporting the cargo oil, while the second upper chamber 7B is usable for supplying and discharging water ballast. Accordingly the double bottom is internally provided with a well 9 adapted to communicate with a bottom portion of a hold 2 and communicating with the first upper chamber 7A through a connecting pipe 10. The second upper chamber 7B communicates through a bellmouth 11 with a ballast tank 12 provided in the interior of the double bottom. On the other hand, the lower chamber 8 is provided with docking brackets 13 conforming to the sectional shape thereof. When the ship is supported on a keel block 14 while in a dock, the docking brackets 13 serves to prevent the double bottom from deforming under gravity. Indicated at 15 are weight reduction holes formed in the connecting longitudinal members 5A of the bottom portion other than the one in the center, and at 16 are buckling preventing, longitudinal stiffeners attached to the bottom portion connecting longitudinal members 5A other than the three central longitudinal members.

Unlike the conventional hull structure, the double shell structure has no reinforcing transverse members, so that the inner hull plating 3 and the outer hull plating 4 have reduced strength against buckling. To compensate for this, the connecting longitudinal members 5 are provided in a larger number with a smaller spacing. Further because of such arrangement, other small longitudinal members are dispensed with. The force acting on the connecting longitudinal member 5A of the bottom portion will not be delivered to the inner and outer side platings 3, 4 because of absence of reinforcing transverse members. Conversely the force acting on the connecting longitudinal member 5B of the side portion will not be transmitted to the inner and outer bottom platings 3, 4 or to the upper deck portion similarly owing to the absence of reinforcing transverse members. Such forces are all transmitted to the front and rear transverse bulkheads 17 of the hold 2, so that the transverse bulkheads 17 are correspondingly reinforced. For example, the bulkheads 17 are made of corrugated plates so as to withstand forces acting in any direction. When required, structural box members are provided around the bulkheads. The upper deck plating 18 shown has substantially the same structure as heretofore used and is therefore provided with reinforcing members as suitably arranged (not shown).

Although the bottom portion and the opposite side portions only are adapted to have the double shell structure according to the above embodiment, the upper deck portion may of course have such a double shell structure similarly. Furthermore, fluid piping can be provided in the space defined by the connecting longitudinal members 5A.

What is claimed is:

1. A ship having at least its side portions and bottom portion comprised of a double hull construction comprising an inner hull plating and an outer hull plating connected together by transverse bulkheads and a plurality of connecting longitudinal members fixed to the transverse bulkheads, the bottom portion of the ship having a space defined by at least two adjacent connecting longitudinal members, characterized in that (a) there are no reinforcing transverse members, other than said transverse bulkheads, intersecting said connecting longitudinal members, and (b) said space is divided by a horizontal partition into upper chamber means and a lower chamber, said upper chamber means being adapted in its entirety to pass at least one fluid therethrough, said lower chamber being provided with docking brackets each conforming to the sectional shape thereof.

2. A ship as defined in claim 1 wherein the or each upper chamber means is subdivided by a second partition into a first upper chamber and a second upper chamber, and the first and second upper chambers are adapted for passing different fluids individually therethrough.

3. A ship as defined in claim 2 wherein the or each first upper chamber communicates through a connecting pipe with a well formed in the double bottom.

4. A ship as defined in claim 2 wherein the or each second upper chamber communicates through a bellmouth with a ballast tank formed in the double bottom.

* * * * *